US005597162A

United States Patent [19]

Franklin

[11] Patent Number: 5,597,162

[45] Date of Patent: Jan. 28, 1997

[54] POKER GAME WHERE PLAYERS ARE GIVEN TWO CHANCES AT RECEIVING REPLACEMENT CARDS

[76] Inventor: Thomas L. Franklin, 810 Ford St., Gulfport, Miss. 39507

[21] Appl. No.: 579,097

[22] Filed: Dec. 27, 1995

[51] Int. Cl.[6] ..... A63F 1/00

[52] U.S. Cl. ..... 273/292; 273/274

[58] Field of Search ..... 273/292, 309, 273/274, 85 CP; 463/13

[56] References Cited

U.S. PATENT DOCUMENTS 4,861,041 8/1989 Jones et al. ..... 273/292

OTHER PUBLICATIONS

Scarne's Encyclopedia Of Games by John Scarne, Harper and Row Publishers, p. 39 Dec. 1973.

*Primary Examiner*—Benjamin H. Layno
*Attorney, Agent, or Firm*—Quirk & Tratos

[57] ABSTRACT

A card game is disclosed. Each player places a first bet. A dealer deals himself four cards, three cards are dealt face-down and his last card is dealt face-up, the dealer then deals each player three cards face-down. Each player may then elect to stay or replace one of his three cards. Each player may then elect to stay or replace a card again. If the player elects to replace a card, he must place a second bet. Each player's hand is then compared to the best three-card hand of the dealer, with the party having the highest hand as determined from a pre-set schedule of hands declared the winner. In a variation of the game, the player wins a jackpot amount if he places a jackpot bet along with the first bet and is dealt a predetermined winning hand in his first three cards.

15 Claims, 1 Drawing Sheet

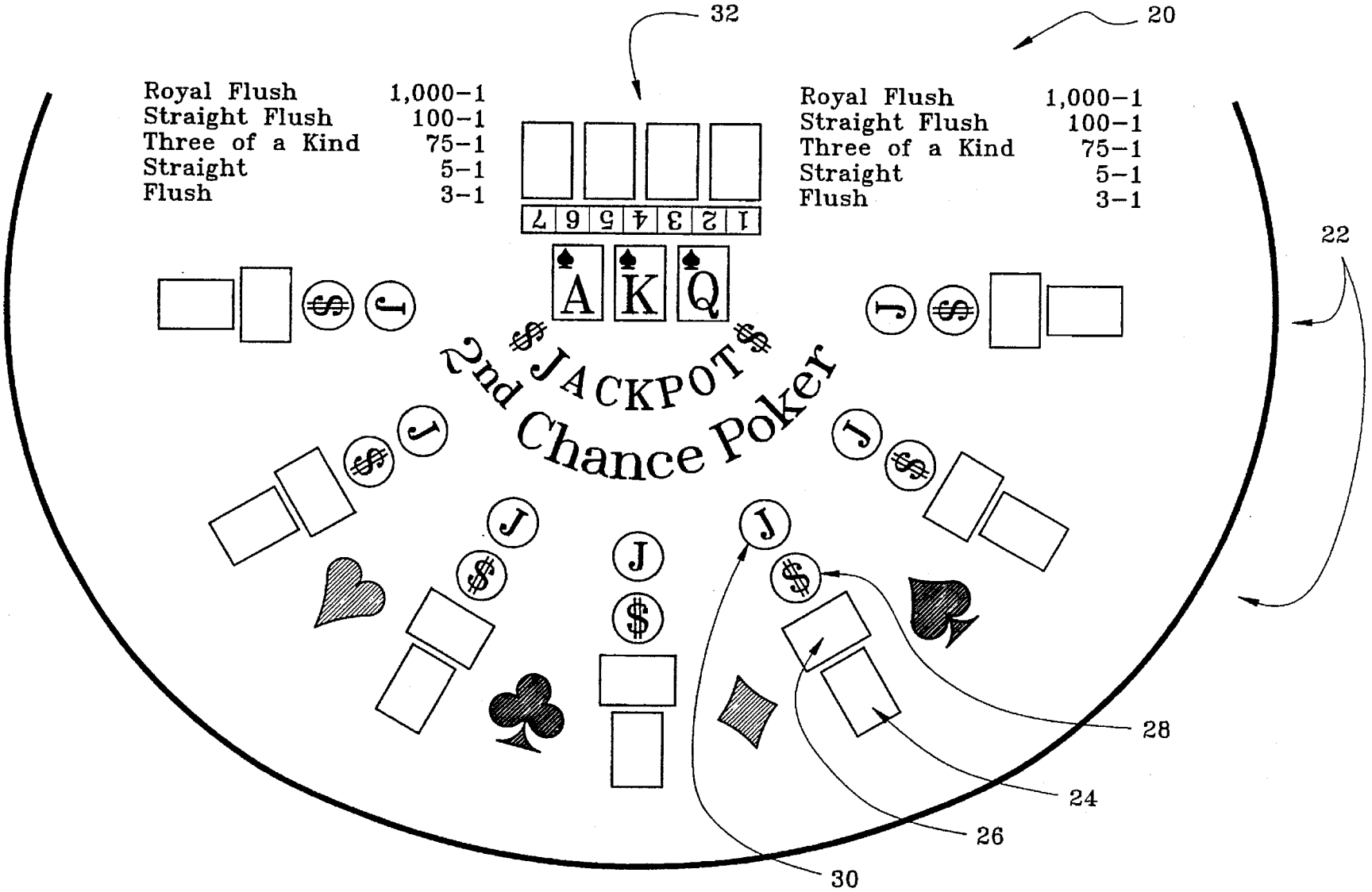
22
20
32
28
24
26
30
Royal Flush 1,000-1
Straight Flush 100-1
Three of a Kind 75-1
Straight 5-1
Flush 3-1
Royal Flush 1,000-1
Straight Flush 100-1
Three of a Kind 75-1
Straight 5-1
Flush 3-1
1 2 3 4 5 6 7
$JACKPOT$
2nd Chance Poker

POKER GAME WHERE PLAYERS ARE GIVEN TWO CHANCES AT RECEIVING REPLACEMENT CARDS

FIELD OF THE INVENTION

The present invention relates to a card game.

BACKGROUND OF THE INVENTION

Gambling has become increasing popular throughout the world. As the popularity of gaming has increased, the desire for new and exciting games of chance has grown as well.

Poker is a card game which has always been fairly popular, and has the advantage of being well-known to a large percentage of the population. Poker is a game in which players place bets and receive cards, with the winner of the game being the player with the highest hand based on a pre-set hierarchy of hands.

In most games of poker, the dealer deals himself and each player of five or seven cards. In the five-card variation, each player is normally given the opportunity to discard as many cards as he likes and take replacement cards, in an attempt to create a five-card hand of as high of a value as possible. In the seven-card variation, each player normally selects the best five cards and discards the other two cards. In either variation, the player is given little opportunity to make a good hand. Further, a player often cannot evaluate how good of a hand he must assemble in order to beat the dealer, as in many instances he is not allowed to view any of the dealer's cards.

A card game which incorporates many of the attributes of poker, but which adds excitement and increases player participation and decision-making is desired.

SUMMARY OF THE INVENTION

The present invention is an improved card game. The card game of the present invention is similar to poker, except that it allows, upon placing a required bet, the player to replace cards in his hand in an attempt to create a better hand.

In the game of the present invention, each player places a first bet. The dealer deals himself four cards, one of which is face-up. The dealer deals each player three cards, each face-down.

Each player then elects to stay or replace one of the cards in his hand. The dealer deals a replacement card and collects the discard from each player who wishes to replace a card.

Each player then again evaluates whether to stay or replace one of the cards in his hand. Each player who wishes to replace a card places a second bet in an amount equal to the first bet. Each player placing a second bet discards a card and receives a replacement card from the dealer.

After the dealer deals all replacement cards, the dealer turns over his cards and creates the highest three-card hand possible from his four cards, and discards the unused card. Each player who has a hand of higher value than the dealer (on a predetermined schedule of hands) wins an amount equal to his first bet. Each player who has a hand of lower value than the dealer loses his first, and if applicable, his second, bet. Each player who has a hand of the same value as the dealer receives no winnings, but keeps his bets.

In a variation of the present invention, at the time each player places his first bet, he may place a "jackpot" bet. If a player places a jackpot bet and his first three cards are of a predetermined winning hand, that player wins a predetermined jackpot amount.

Further objects, features, and advantages of the present invention over the prior art will become apparent from the detailed description of the drawings which follows, when considered with the attached figures.

DESCRIPTION OF THE DRAWINGS

FIG. 1 illustrates a table layout for use in playing the game of the present invention.

DETAILED DESCRIPTION OF THE PREFERRED EMBODIMENT

The present invention comprises a card game. The improved card game will be described with reference to the game layout 20 illustrated in FIG. 1. The layout 20 is preferably mounted for use on the top of a conventional gaming table (not shown) positioned at a suitable location in a casino. Playing locations 22 are provided for each player, with the maximum number of locations normally not exceeding seven. Each player location 22 has a designated area 24 for dealt cards, for discards 26, for first and second bets 28, and for a jackpot bet 30. A dealer's location 32 is provided opposite the playing locations 22.

Standard playing cards (52 cards per deck) are preferably used to play the game. More than one deck of cards may be shuffled together for use in the game, or a single deck of cards may be used.

In general, the game involves the following sequence of play: (1) each player places a first bet or ante; (2) the dealer deals himself four cards, one of which is exposed, and each player three cards; (3) each player is given the option of replacing one of his three cards; (4) each player is given another chance to replace a card upon placing a second bet equal to their first bet; and (5) each player's three-card hand is compared to the best three of the four cards belonging to the dealer to determine the winner. As an important option, each player may place a "jackpot bet" before the game begins, which bet is paid if the player's first three cards result in a predetermined winning hand.

The game of the present invention will now be described in detail with reference to the layout 20 illustrated in FIG. 1.

First, each player who wishes to participate places an "ante" or "first bet" in the bet space 24 in front of him. Once each player who wishes to participate in the game has placed his first bet, the dealer calls "no more bets," after which time no additional players may join the game, and existing players are prevented from quitting the game without losing their first bet.

The dealer deals himself a card and then each of the players, preferably in clockwise fashion. The dealer deals cards until each player has three cards, each dealt face-down. The dealer ends distributing the first round of cards by dealing himself a fourth card, dealt face-up.

Each player then inspects his cards, and elects to stay or "draw" by replacing a card. If the player elects to stay, he places his cards face-down on the layout 20 under his ante. Each player who wishes to replace a card places one discard card in the discard space 26 on the layout 20. The dealer moves clockwise, taking each discard card and replacing it with a new card. Preferably, the dealer "burns" or discards the top card from the stack of cards from which he is dealing before dealing replacement cards.

Having evaluated the dealer's face-up card, each player now has a "second chance" or another opportunity to replace a card. In this second round of card replacement, a player may again elect to stay or "draw" and replace a card. Each player who wishes to stay places his cards face-down on the layout 20.

Each player who wishes to replace a card places a second bet in the amount equal to the original first bet in the bet 28 spot in front of him. The player also places the card he wishes to discard in the discard spot 26 on the layout 20.

For each player who has paid the second bet and discarded a card, the dealer replaces the discarded card with a new card. Preferably, the dealer again "burns" the top card before dealing the replacement cards to the players.

Once the dealer has dealt all replacement cards, the dealer turns over his remaining down cards. The dealer then makes the best "hand" possible using three of the four cards.

Preferably, the ranking or value of the hands is as follows, from highest hand to lowest hand: (1) royal flush (ace, king and queen all of the same suit); (2) straight flush (three consecutive cards all of the same suit other than ace, king and queen); (3) three-of-a-kind (three of the same value cards); (4) a straight (three cards of consecutive value, no matter whether they are of the same suit); (5) a flush (three cards of the same suit); (6) highest pair (two cards of equal rank); (7) three highest cards (the three cards having the highest rank). In determining the value and suit of a card, traditional rules of card play, particularly with respect to poker, are employed, as is well known. It is noted that the ranking of the hands in the game of the present invention is thus similar to the ranking in standard poker games, except that a straight has a higher value than a flush.

Each player compares his three card hand to the three card hand of the dealer. Each player having a hand which is of a higher value or rank than the dealer's hand is paid an amount equal to the original first bet or ante, with the player also keeping his first bet, and if placed, his second bet. If a player and the dealer have hands which are equal in value, the game is a "push" and the player neither wins nor loses, and retains his first (and if placed, second) bet. If the dealer's hand is of a higher value than the player's, then the dealer collects the first and second bets placed by the player.

In a preferred variation of the present invention, each player has, at the time he places his first bet, the option of placing a "jackpot bet." The player places the jackpot bet in the jackpot bet space 30 on the layout.

After the dealer deals the initial three cards to each player, each player having placed a jackpot bet determines whether he has a "jackpot hand." In particular, if the player has a hand which matches a pre-selected winning hand, the dealer pays that player a winning payout.

In the preferred version of the game, each player who has placed a jackpot bet and has one of the hands listed below is paid a jackpot amount: royal flush, straight flush, three-of-a-kind, straight, and a flush.

Preferably, if the player has a jackpot hand, the player calls his hand immediately after he receives his first three cards, and the dealer places a jackpot button on top of the player's three face-down cards. Play of the game then continues with respect to the other players as described above.

Once the dealer's hand is set, the winners and losers of the first and second bets are determined as described above. Each player having a jackpot hand also compares his hand to the dealer's hand to determine if he has won or lost. The dealer collects the player's first bet if he lost, and pays the first bet if he won. In addition, however, the dealer pays the player winnings for having a jackpot hand.

Preferably, the amount the dealer pays the player is as follows: 1000 times the jackpot bet for a royal flush, 100 times the player's jackpot bet for a straight flush, 75 times the player's jackpot bet for a three-of-a-kind, 5 times the player's jackpot bet for a straight, and 3 times the player's bet for a flush.

Of course, the particular style of play may vary from that described above without departing from the invention.

For example, any type of bet means may be used in playing the game, such as coins, tokens, chips paper money, or the like. The casino, dealer, or even the players may elect to set a pre-set minimum first bet. The casino, dealer or players may also select a pre-set first bet from which no variation, higher or lower, is allowed.

The bet which the player must place to participate in the jackpot may be any amount the player wishes to bet, or a pre-set amount, such as $1, $5 or $10.

While the layout 20 shown in FIG. 1 is preferred, many variations of the layout are acceptable for use in playing the game of the present invention. Further, the game of the present invention may be played without a layout, such as on a bare table or floor. Use of a layout is preferred, however, as it maintains the order and flow of the game.

The particular hands which are deemed "jackpot" hands may comprise any number of variations of three-cards. For example, a jackpot hand might comprise a 2, a 4 and a 6, all of the same suit. The jackpot payout for a jackpot hand may also vary from those payout described above. Preferably, however, each payout is relative to the percentage odds of a player achieving that particular combination of cards.

As a further aspect of the present invention, several security measures may be employed for use by casinos or the like in making sure the game is played fairly. For example, the dealer may collect bets and place them in a rack or coin drop. Cards may be pre-shuffled and dealt from a shoe of cards. The play of the game may be monitored by security via a video camera or the like.

It will be understood that the above described arrangements of apparatus and the method therefrom are merely illustrative of applications of the principles of this invention and many other embodiments and modifications may be made without departing from the spirit and scope of the invention as defined in the claims.

I claim:

1. A method of playing a card game using a deck of fifty-two cards comprising the steps of:

(a) a player placing a first bet;

(b) a dealer dealing a player hand of only three cards to the player and only four cards to himself three of the dealer's cards dealt face down;

(c) the player electing to stay or to obtain a first replacement card for his hand, and wherein if said player elects to take a first replacement card, said player discarding one of his three cards and said dealer dealing said player a replacement card;

(d) the player examining his three cards and the dealer's exposed card, then the player electing to stay or obtain a second replacement card for his hand, and wherein if said player elects to take a second replacement card, said player placing a second bet and discarding one of his three cards and said dealer dealing said player a replacement card; and (e) the dealer assembling from his four cards the highest possible three card dealer hand according to the following ranking of hands from highest to lowest,
(1) royal flush (ace, king, queen of the same suit),
(2) straight flush (three consecutive cards of the same suit),
(3) three of a kind,
(4) straight,
(5) flush,
(6) pair,
(7) three highest cards, and (f) determining the winner of said game by comparing the hand of the player to the hand of the dealer, the hand with the highest ranking declared the winner.

2. The game of claim 1, wherein said player must place a second bet in order to obtain a second replacement card.

3. The game of claim 2, wherein said first bet and said second bet are equal.

4. The game of claim 3 wherein when the player is declared the winner, the dealer pays the player an amount equal to the first bet and when the dealer is declared the winner, the dealer collects said first bet and, if placed, the second bet.

5. The game of claim 1, further including the step of placing a jackpot bet.

6. The game of claim 5, further including the step of awarding a jackpot amount to said player if said player is dealt a predetermined hand made up of said first three cards.

7. The game of claim 6, wherein said predetermined hands comprise a royal flush, straight flush, three-of-a-kind, straight, and flush.

8. A method of playing a card game comprising the steps of:

(a) obtaining at least one deck of at least 52 standard playing cards;

(b) a player placing a first bet;

(c) a dealer dealing only four cards to himself, three cards face-down and one card face-up;

(d) the dealer dealing the player only three cards face-down;

(e) the player examining his three cards and the dealer's exposed card, then the player electing to stay or replace one of said three cards in his hand, and if said player elects to replace one of said cards, said player discarding a card and said dealer dealing said player a new card;

(f) the player electing to stay or again replace one of said three cards in his hand, and if said player elects to again replace one of said cards, said player placing a second bet and discarding one of said cards, and said dealer dealing said player a new card;

(g) said dealer forming a hand of three cards from said four cards, discarding one of said cards;

(h) determining the winner of said event by comparing said player's hand to said dealer's hand.

9. The game of claim 8, wherein said first bet and said second bet are equal.

10. The game of claim 8 wherein the player wins the game if said player has a hand of a higher rank than said dealer, and said dealer wins the game if said dealer has a hand of a higher rank than said player.

11. The game of claim 10, wherein said rank of said hands are, from highest to lowest in rank: royal flush, straight flush, three-of-a-kind, a straight, a flush, highest pair, and three highest cards.

12. The game of claim 8, further including the step of placing a jackpot bet.

13. The game of claim 12, further including the step of awarding a jackpot amount to said player if said player is dealt a predetermined hand made up of said first three cards.

14. The game of claim 13, wherein said predetermined hands comprise a royal flush, straight flush, three-of-a-kind, straight, and flush.

15. A method of playing a card game using a deck of fifty-two cards comprising the steps of:

(a) a player placing a first bet;

(b) a dealer dealing a player hand of only three cards to the player and only four cards to himself, three of the dealer's cards dealt face down (c) the player examining his three cards and the dealer's exposed card, then the player electing to stay or to obtain a free first replacement card for his hand, and wherein if said player elects to take a first replacement card, said player discarding one of his three cards and said dealer dealing said player a replacement card;

(d) the player electing to stay or obtain a second replacement card for his hand, and wherein if said player elects to take a second replacement card, said player placing a second bet and discarding one of his three cards and said dealer dealing said player a replacement card; and (f) the dealer assembling from his four cards the highest possible three card dealer hand according to the following ranking of hands from highest to lowest,
(1) royal flush (ace, king, queen of the same suit),
(2) straight flush (three consecutive cards of the same suit),
(3) three of a kind,
(4) straight,
(5) flush,
(6) pair,
(7) three highest cards, and (f) determining the winner of said game by comparing the hand of the player to the hand of the dealer, the hand with the highest of said ranking declared the winner, the player paid an amount equal to his first bet if he is declared the winner, and the dealer collecting the first bet and, if made, the second bet, if the dealer is declared the winner.

* * * * *